US008047787B1

(12) United States Patent
Liang

(10) Patent No.: US 8,047,787 B1
(45) Date of Patent: Nov. 1, 2011

(54) TURBINE BLADE WITH TRAILING EDGE ROOT SLOT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1089 days.

(21) Appl. No.: 11/900,030

(22) Filed: Sep. 7, 2007

(51) Int. Cl.
*F01D 5/08* (2006.01)

(52) U.S. Cl. ..... 416/97 R

(58) Field of Classification Search ..... 415/115; 416/97 R

See application file for complete search history.

(56) References Cited

U.S. PATENT DOCUMENTS 6,190,128 B1 2/2001 Fukuno et al.
6,481,967 B2 11/2002 Tomita et al.
6,851,924 B2 * 2/2005 Mazzola et al. ..... 415/115

* cited by examiner

*Primary Examiner* — Nathan Wiehe
*Assistant Examiner* — Aaron R Eastman
(74) *Attorney, Agent, or Firm* — John Ryznic

(57) ABSTRACT

A turbine rotor blade for use in an industrial gas turbine engine in which the blade includes a root section with a fillet region formed between the root and the platform of the blade. The platform region includes a diamond shaped root slot to discharge cooling air from the internal cooling passage out through the trailing edge of the blade. The diamond shaped cooling slot of the present invention comprises a smaller radius at the upper and lower corners and a much larger radius at the mid section of the slot. The cooling slot is positioned in the trailing edge root section where the upper corner is positioned above the fillet run out location. The diamond shaped cooling slot thus minimizes the high stresses induced by the stress concentration from the cooling slot and the fillet run out location.

6 Claims, 4 Drawing Sheets

TURBINE BLADE WITH TRAILING EDGE ROOT SLOT

BACKGROUND OF THE INVENTION

1. Field of the Invention

The present invention relates generally to a turbine blade in a gas turbine engine, and more specifically to cooling of the fillet along the trailing edge of the turbine blade.

2. Description of the Related Art including information disclosed under 37 CFR 1.97 and 1.98

In an industrial gas turbine engine, the hot gas flow developed within the combustor is passed through a multiple staged turbine to convert the hot gas flow into mechanical energy by rotating the shaft of the engine. It is well known, in the art of gas turbine engines, that the engine efficiency can be increased by providing for a higher gas flow temperature entering the turbine. However, the highest temperature that can be passed into the turbine is depended upon by the material properties and the cooling effectiveness of the first stage stator vanes and rotor blades, since these airfoils are exposed to the highest temperature flow.

Also in an industrial gas turbine engine, the life of a particular blade or vane is another important factor. When a turbine part is damaged from thermal or stress degradation, the engine cannot operate for a long period of time or the efficiency is decreased from a damaged part. The first stage turbine blade of an IGT engine is exposed to a stream of working fluid that is extremely hot (above 2000 degrees F.) and moving very quickly (above 500 ft/second). The rotor blades and stator vanes in this environment must tolerate not only extreme thermal loads, but also high-magnitude dynamic loads as well. As a result, these turbine parts are traditionally rigid, internally cooled structures that often include external thermal barrier coatings.

While robust architecture and thermal barrier coatings help the blades and vanes withstand external thermal and mechanical loads, they do not address all of the issues associated with exposure to the working fluid. For example, non-uniform temperature distribution between the cooled airfoil portions and relatively hot shroud portions introduces thermal gradients that produce internal thermal stresses. Cooling channel exits also produce localized thermal stresses, by inducing thermal gradients in the areas immediately surrounding the exits, as a result of sharp drops in temperature.

In these airfoils, thermal stress of an especially large magnitude occurs between the base portion and the platform of the rotor blade. The reason for this can be explained by the fact that since the moving blade has a smaller heat capacity than the platform, the temperature of the moving blade increases at a higher rate and within a shorter time period than that of the platform upon start of the gas turbine. On the other hand, the temperature of the moving blade falls at a higher rate and within a shorter time than that of the platform, whereby a large temperature difference occurs between the moving blade and the platform. This in turn generates thermal stress. Consequently, the base portion is shaped in the form of a curved surface conforming to the fillet ellipse to thereby reduce the thermal stress.

Recently, however, there is an increasing tendency to use a high temperature combustion gas to enhance the operating efficiency of the gas turbine. As a result, it becomes impossible to sufficiently suppress the thermal stress with only the base portion structure shaped in the form of the above mentioned fillet ellipse portion R, and cracks develop more frequently in the base portion where large thermal stress is induced. Under these circumstances, there is a demand for a structure of the blade base portion that is capable of reducing the thermal stress more effectively.

U.S. Pat. No. 6,481,967 B2 issued to Tomita et al on Nov. 19, 2002 and entitled GAS TURBINE MOVING BLADE shows a turbine rotor blade in FIGS. 1 and 2 with a row of trailing edge discharge cooling slots to provide cooling to the trailing edge and the fillet formed between the airfoil portion and the platform of the blade. High thermally induced stress is normally predicted at the junction of the blade trailing edge and the platform location. Also, due to the different effectiveness level of cooling mechanism used for the blade and platform and to the mass distribution between the blade and the platform, the thermally induced strain during transient cycle becomes much more severe. One method to alleviate this high thermal strain is by the use of a compounded fillet radii as shown in FIG. 3 which is disclosed in U.S. Pat. No. 6,851,924 B2 issued to Mazzola et al U.S. Pat. No. 6,851,924 B2 on Feb. 8, 2005 and entitled CRACK-RESISTANCE VANE SEGMENT MEMBER. As a result of this approach, the blade root section wall thickness must be increased which lowers the effectiveness of the trailing edge root section cooling slot. This results in a hotter trailing edge fillet metal temperature and a lower low cycle fatigue (LCF) capability.

It is an object of the present invention to provide for a turbine blade with a trailing edge root section cooling slot that will reduce the metal temperature in order to increase the LCF over the cited prior art references.

BRIEF SUMMARY OF THE INVENTION

A turbine rotor blade for use in an industrial gas turbine engine in which the blade includes a root section with a fillet region formed between the root and the platform of the blade. The platform region includes a diamond shaped root slot to discharge cooling air from the internal cooling passage out through the trailing edge of the blade. The diamond shaped cooling slot of the present invention comprises a smaller radius at the upper and lower corners and a much larger radius at the mid section of the slot. The cooling slot is positioned in the trailing edge root section where the upper corner is positioned above the fillet run out location. The diamond shaped cooling slot thus minimizes the high stresses induced by the stress concentration from the cooling slot and the fillet run out location.

DETAILED DESCRIPTION OF THE INVENTION

The present invention is disclosed as a turbine rotor blade for use in an industrial gas turbine engine first stage. However, the diamond shaped cooling slot of the present invention could be used in a stator vane or in an aero engine.

Figure 1:
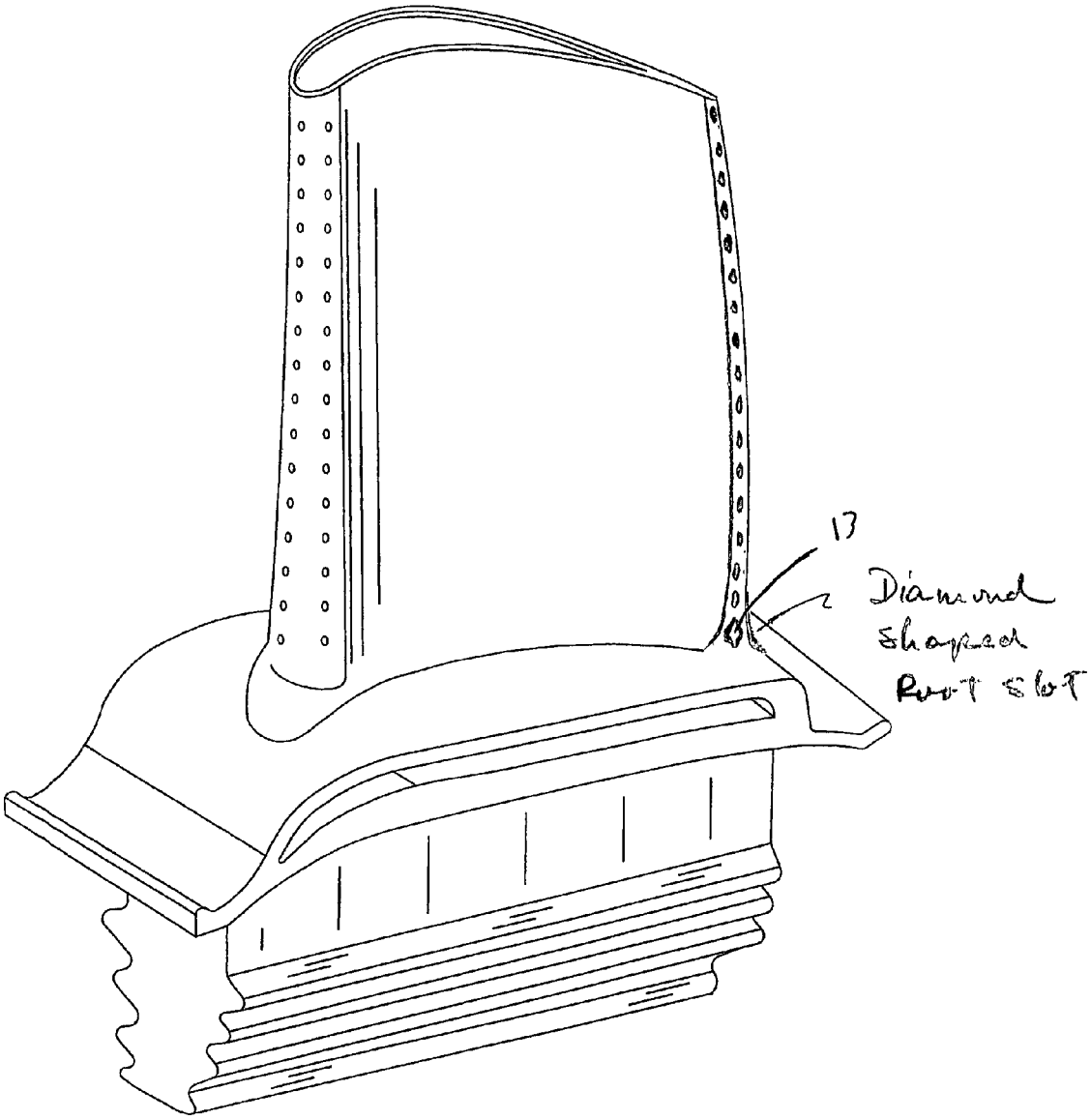
FIG. 1 shows a schematic view of a first stage turbine rotor blade of the prior art with the diamond shaped root cooling slot of the present invention.
Figure 2:
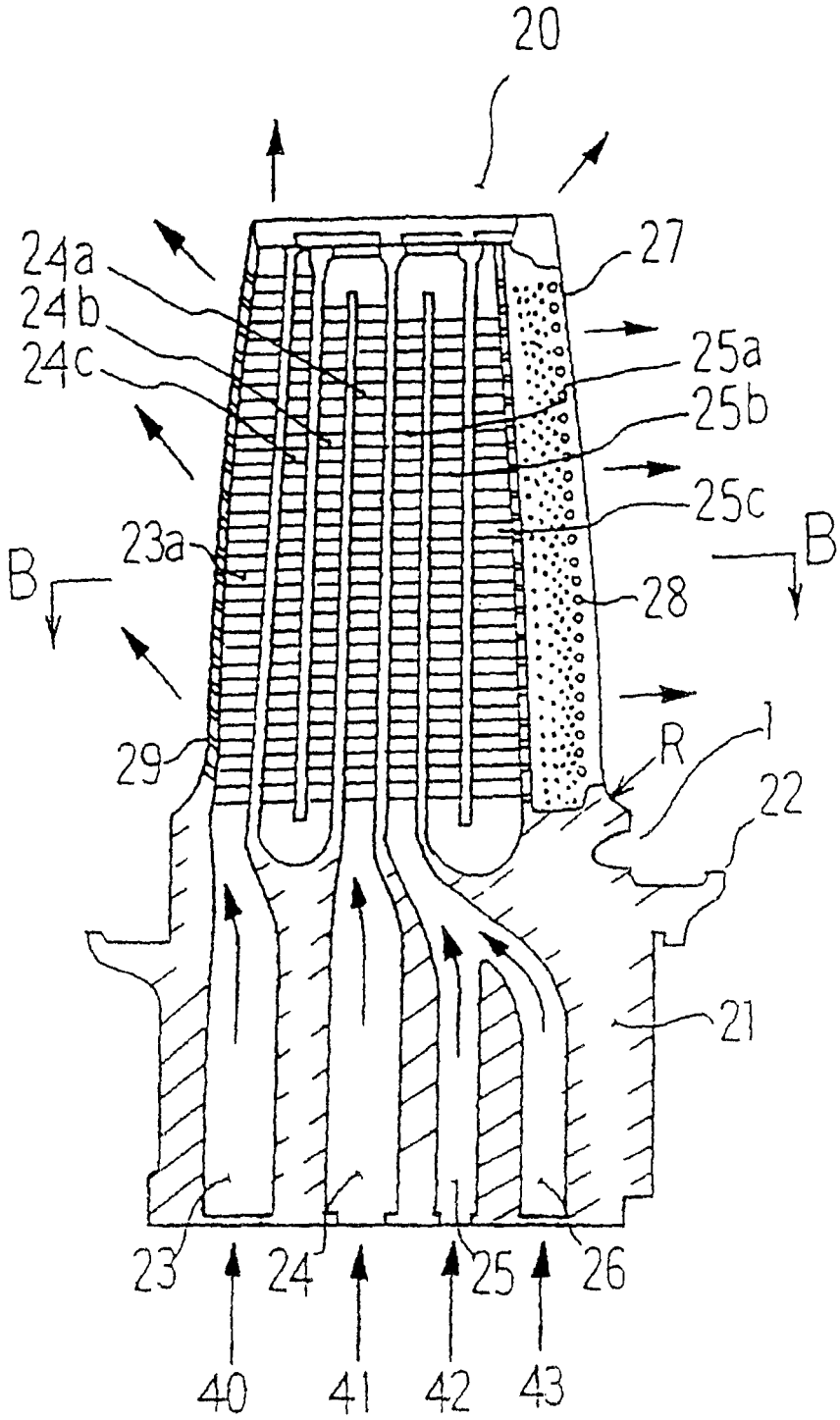
Fig. 2 prior art
FIG. 2 shows a cross section side view of the turbine blade of FIG. 1.
Figure 3:
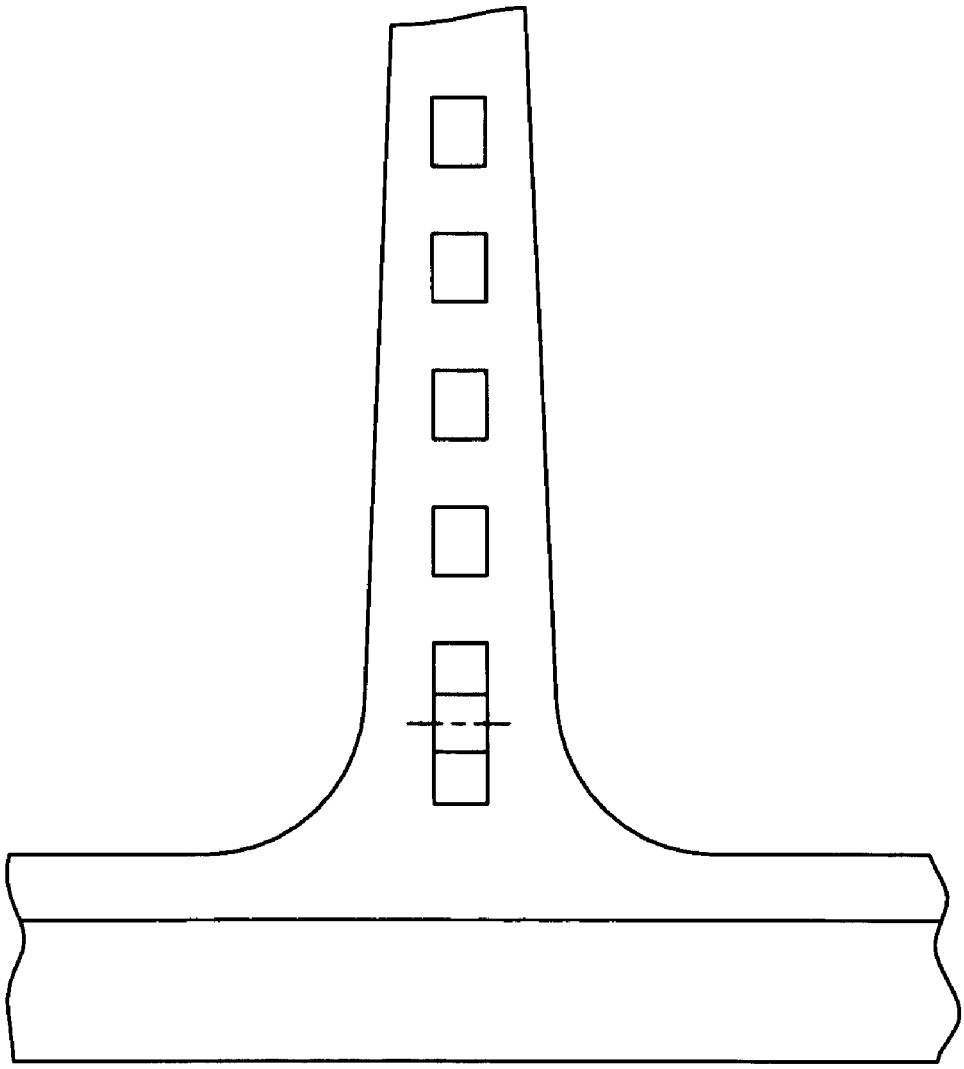
Fig 3 Prior Art
FIG. 3 shows a rear view of the trailing edge of a turbine blade of the prior art with a cooling slot opening onto the fillet region of the blade.
Figure 4:
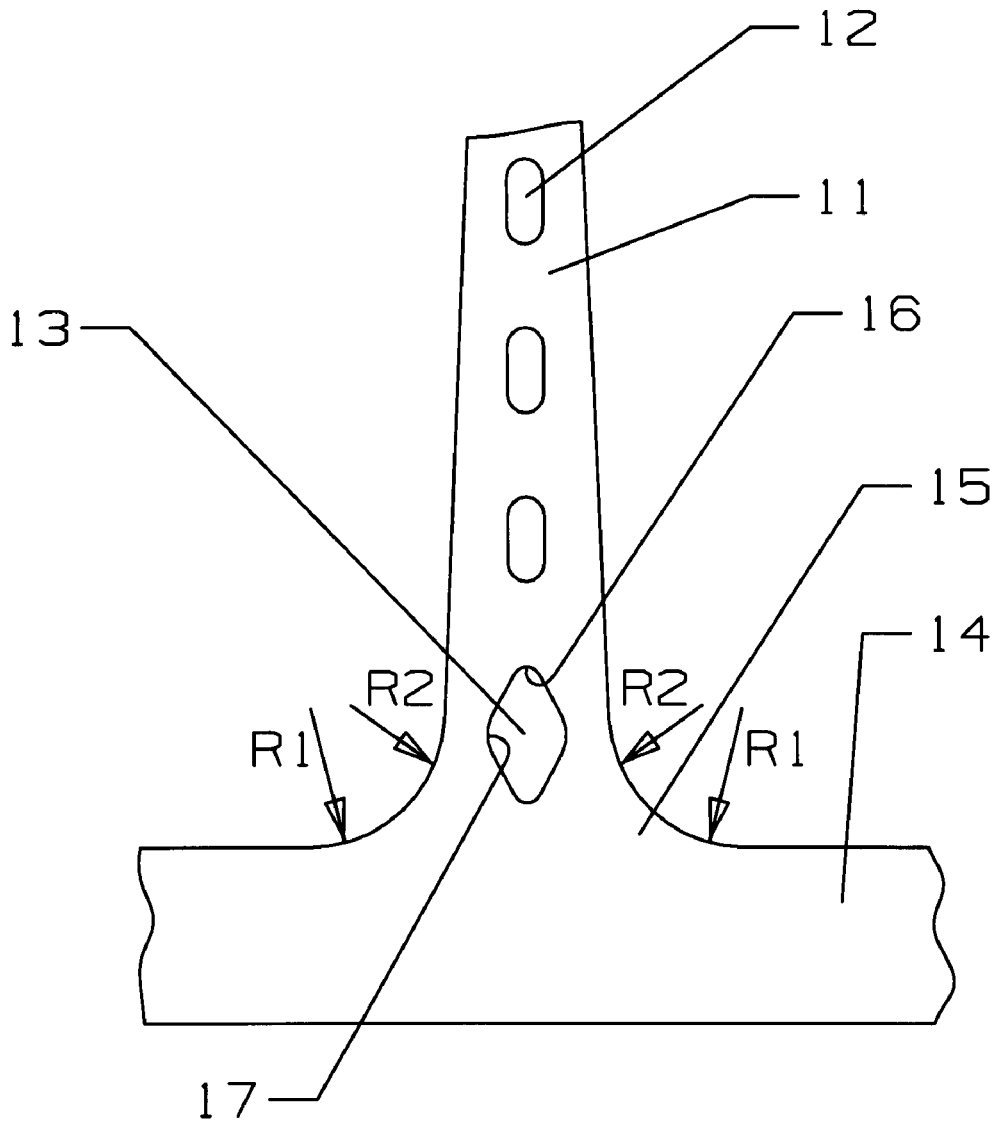
FIG. 4 shows the diamond shaped cooling slot of the present invention is a turbine blade fillet region.

FIG. 4 shows a rear view of the turbine rotor blade of the present invention with a diamond shaped cooling slot 13. The turbine blade includes a trailing edge 11 with a row of trailing edge cooling holes 12 extending from near the blade tip toward the platform 14 of the blade. These cooling holes 12 are connected to the internal cooling supply passages that pass through the blade such as a serpentine flow cooling circuit. A fillet region 15 is formed between the airfoil portion of the blade and the platform 14 as is well known in the prior art. A compound fillet radii is used as disclosed in the prior art Mazzola wet al U.S. Pat. No. 6,851,924 B2 described above. The compound radii include a first radius R1 and a second Radius R2. However, the fillet can be a single radius is warranted.

A diamond shaped root cooling slot 13 is located in the fillet region 15 of the blade trailing edge to provide cooling. The diamond shaped cooling slot 13 includes a small corner radius 16 on the top and bottom corners of the slot, and a large mid-slot radius 17 on both sides of the slot 13. The slot 13 is also connected to the internal cooling supply passages such that cooling air is discharged out through the diamond shaped slot 13 to provide cooling to the fillet 15 of the blade. The slot 13 is positioned in the trailing edge fillet region so that the smaller radius at the upper corner is above the fillet run out location. This will minimize the high stresses induced by the stress concentrations from the cooling slot and the fillet run out location.

The diamond shaped fillet cooling slot of the present invention provides for a number of major advantages over the above cited prior art references. Lower stress levels are achieved due to the location of the cooling slot upper corner. A higher channel cooling effectiveness in achieved due to a shorter conduction distance and an increased internal cooling convection area, which results in a cooler root section fillet metal temperature and a higher LCF capability. Lower thermal gradient due to a thinner wall, which results in a lower thermal stress and strain range and a higher blade operating life. A smoother stress load path due to the shaping of the cooling slot.

I claim the following:

1. A turbine blade for a gas turbine engine, the blade comprising:

A platform;

An airfoil extending from the platform and having a row of trailing edge cooling holes to provide cooling for the trailing edge region of the blade;

A fillet formed between the airfoil portion and the platform;

A diamond shaped cooling slot located in the trailing edge and between the platform and the lowest trailing edge cooling hole, the diamond shaped cooling slot discharging cooling air from an internal cooling passage out through the trailing edge of the blade; and, The diamond shaped cooling slot includes a smaller radius upper and lower corner, and a larger radius mid-slot corner.

2. The turbine blade of claim 1, and further comprising:

The upper corner is located above the fillet run out location.

3. The turbine blade of claim 1, and further comprising:

The diamond shaped cooling slot includes an upper corner located above the fillet run out location.

4. The turbine blade of claim 3, and further comprising:

The diamond shaped cooling slot includes a lower corner located above the platform surface of the blade.

5. The turbine blade of claim 1, and further comprising:

The fillet includes a compound radius with a first radius and a second radius.

6. The turbine blade of claim 1, and further comprising:

The diamond shaped cooling slot has a cross sectional width less than the cross sectional height of the slot.

* * * * *